US006105222A

United States Patent [19]

Fleissner

[11] Patent Number: 6,105,222

[45] Date of Patent: Aug. 22, 2000

[54] DEVICE WITH A NOZZLE BEAM FOR PRODUCING LIQUID STREAMS FOR STREAM BRAIDING OF FIBERS ON A TEXTILE WEB

[75] Inventor: Gerold Fleissner, Zug, Switzerland

[73] Assignee: Fleissner GmbH & Co., Egelsbach, United Kingdom

[21] Appl. No.: 09/338,595

[22] Filed: Jun. 23, 1999

[30] Foreign Application Priority Data

Jun. 24, 1998 [DE] Germany ..... 198 28 118

[51] Int. Cl.[7] ..... D04H 1/46; D04H 3/08

[52] U.S. Cl. ..... 28/104

[58] Field of Search ..... 28/104, 105, 167, 28/168, 169; 239/553.5, 590.5

[56] References Cited

U.S. PATENT DOCUMENTS

| | | | |
|---|---|---|---|
| 3,493,462 | 2/1970 | Bunting, Jr. et al. | 28/104 |
| 3,906,130 | 9/1975 | Tsurumi et al. | 28/104 |
| 4,069,563 | 1/1978 | Contractor et al. | 28/105 |
| 4,152,480 | 5/1979 | Adachi et al. | 28/104 |
| 4,476,186 | 10/1984 | Kato et al. | 28/104 |
| 4,548,628 | 10/1985 | Miyake et al. | 28/104 |
| 4,647,490 | 3/1987 | Bailey et al. | 28/104 |
| 5,281,441 | 1/1994 | Kasai et al. | 28/104 |
| 5,692,278 | 12/1997 | Fleissner . | |
| 5,701,643 | 12/1997 | Fleissner . | |
| 5,888,916 | 3/1999 | Tadokoro et al. | 28/104 |

OTHER PUBLICATIONS

Patent Abstracts of Japan, vol. 17, No. 655 (C–1136) Dec. 6, 1993 and JP 05209360 of Aug. 20, 1993 (Daiwabo Create KK).

Batabase Section CH, week 8533, Derwent Publications and Japan 60126358 of Jul. 5, 1985 (Toray Ind. Inc.).

*Primary Examiner*—Amy B. Vanatta

*Attorney, Agent, or Firm*—Antonelli, Terry, Stout & Kraus, LLP

[57] ABSTRACT

Devices for water needling consists of a nozzle beam that is located transversely above the fiber web to be compacted. The water emerges in fine streams at high pressure from a plurality of nozzles and tangles the fibers to compact them, to change the surface, and to braid the fibers of the tissue or the like. Since this web must be guided past the nozzle beam, a lengthwise striping develops. In order to influence this advantageously, according to the invention the nozzle beam is caused by a vibrator to perform quite specific transverse oscillations. The resultant zigzag movement, with the generated groove depressions being located with their edges adjacent, produces a completely smooth surface without significant plastic elevations.

21 Claims, 3 Drawing Sheets

Fig. 1
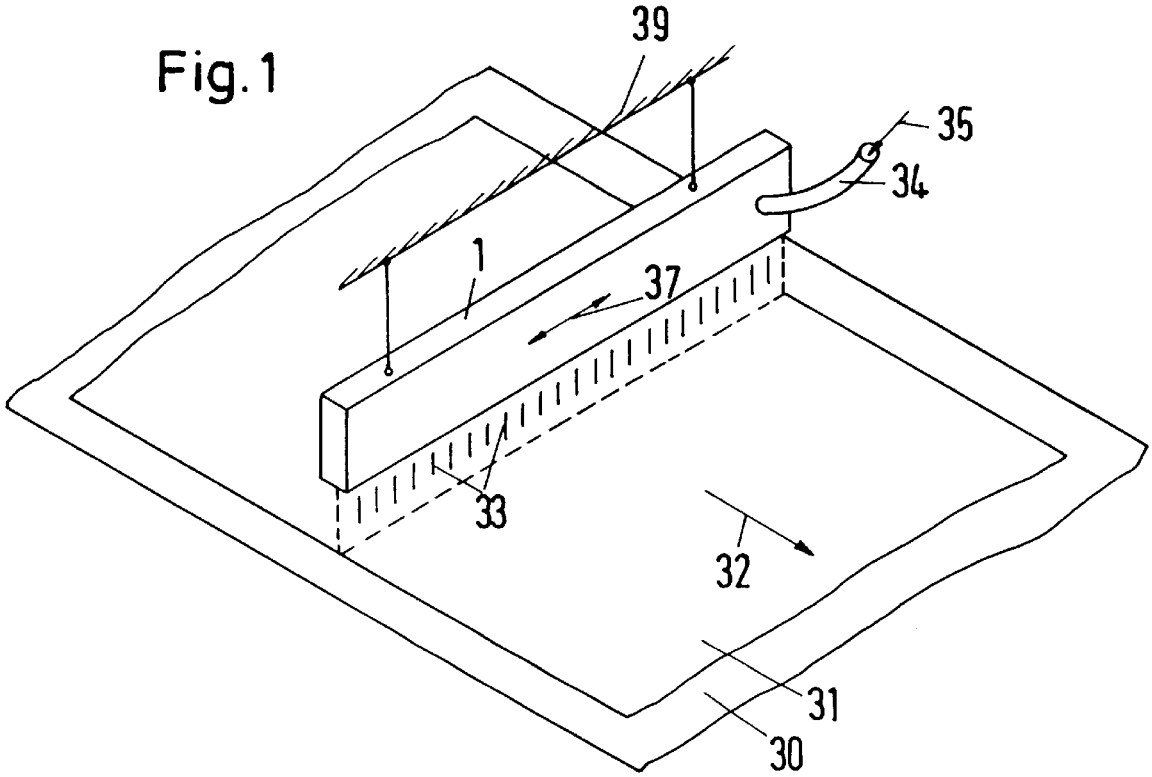
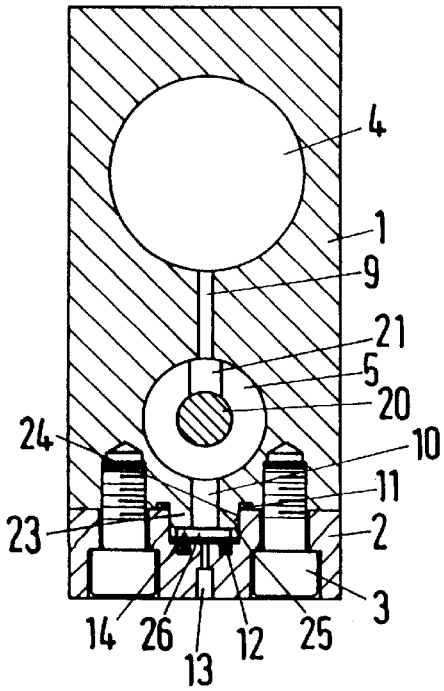
Fig. 2

DEVICE WITH A NOZZLE BEAM FOR PRODUCING LIQUID STREAMS FOR STREAM BRAIDING OF FIBERS ON A TEXTILE WEB

BACKGROUND OF THE INVENTION

The invention relates to a device with a nozzle beam for producing liquid streams for stream braiding of fibers of a textile web advanced diagonally to the nozzle beam by means of a liquid-permeable substrate, such as a fiber web, consisting of an upper part extending over the working width of the fiber web and a lower part fastened thereto that is liquid-tight, with a pressure chamber being located in the upper part over its length, said chamber being supplied endwise for example with liquid under pressure and with a nozzle sheet attached to the lower part in a liquid-tight manner with holes for the nozzles.

A device of this kind is known from U.S. Pat. No. 4,069,563. The nozzle sheet must be provided with holes arranged quite close together so that a sufficient compaction of the fiber web can be achieved by the plurality of nozzle streams per unit length. Since the number of nozzle openings per centimeter is subject to a limit for reasons of the strength of the nozzle sheet, it is proposed In the US patent to provide the nozzle openings in two rows in the nozzle sheet of the nozzle beam and then to locate the holes with gaps between them, possibly also in three rows in succession, offset relative to one another. This measure produces a high density of nozzle streams side by side. Nevertheless, even with this arrangement and the use of the nozzle beam, characteristic linear stripes visible to the naked eye form in the surface of the compacted fiber web.

U.S. Pat. No. 3,493,462 is significant in this connection. In that patent, a plurality of nozzle beams of this kind are mounted transversely above an endless belt in a frame which can be caused to oscillate and vibrate by means of a device in one corner of the frame. The frequency is intended to be 200–300 movements per minute, in other words 2–5 Hz, and the substrate for the fiber web consists either of a piece of sheet metal, pierced with fine holes, or a fabric with high permeability. The document teaches two methods for embossing the surface on the basis of a number of test conditions:

1. With a stationary nozzle beam, a desired linear embossing is produced by the embossing effect of the nozzle streams.

2. With the nozzle beam moving back and forth, a desired embossing with a curved or zigzag shape is produced. The shape of the curves on the fleece depends on the frequency of the oscillating movements, but only one frequency with a maximum of 5 Hz is provided. Nothing whenever is said about the amplitude of the movements. The embossing produced in this fashion is said to be softer while the surface achieved is smoother.

EP 0 132 128 B1 can also be mentioned in this regard. In that document, a frame with a plurality of nozzle beams located side by side is also disclosed which likewise is intended to be caused to perform an oscillating movement as a whole. In contrast to the US patent, a fleece with a surface that is embossed as it rests on the substrate is to be produced, which therefore shows the negative image of the substrate used. The operating conditions for this purpose are likewise an oscillating frequency of 75 to 200 movements, in other words 1–3.3 Hz with an amplitude of 5–50 mm. In one example, with a forward speed of the fleece of 10 meters per minute, a frequency of 2 Hz and an amplitude of 37 mm are selected. With these values, the fleece is embossed with the structure of the substrate but nothing is said about the surface design on the side which the nozzle streams strike.

SUMMARY OF THE INVENTION

The goal of the invention is to develop a device with which the surface directly impacted by the water streams is influenced in such fashion that it has a uniformly dense appearance free of groove-shaped plastic depressions caused by the nozzle streams, although the fiber web is only moved along the beam as before.

Taking its departure from the device of the type recited at the outset, the goal of the present invention is that a) a nozzle beam is mounted so that it can move back and forth lengthwise only in the direction perpendicular to the movement direction of the web;

b) The nozzle beam is connected forcewise with a unit for rapid reciprocating movement, such as a vibrator, perpendicularly to the movement direction of the web, said vibrator alone only causing the one nozzle beam to perform oscillating movements that change at short intervals, c) The oscillating movements of the nozzle beam have a frequency of at least 10 Hz with a forward movement of the fiber web of at least one meter per minute;

d) The diameter of the nozzle holes is greater than or equal to 0.1 mm;

e) The amplitude of the oscillating movements is equal to or greater than one half of the spacing on the holes in the nozzle sheet, but less than 20 mm, for example with a hole spacing of 40 holes per inch in the nozzle sheet it is at least 0.32 mm, and f) The water pressure of the water streams is at least 30 bars.

It is basically true in that only one nozzle beam can be caused to produce oscillating movements per unit. The masses, which for the goal according to the invention in this case must continuously be accelerated again at short intervals, are already very high in a nozzle beam. As a result, the operating conditions of the individual movements are limited in accordance with a mathematical law. In order to be able to produce a microscopically smoother surface with individual liquid streams which always leave behind them a depression in the nonwoven fabric or in the textile or knit, the stream depressions that are produced must be immediately adjacent without any gaps or must even overlap one another.

The water streams striking the surface of the nonwoven fabric are at a distance l from one another that corresponds to the number of nozzle streams in the nozzle sheet, for example 40 hpi. In this example, l equals 0.636 mm. A stream of water from a hole in a nozzle sheet, on striking the fleece, has a certain larger diameter which produces a linear depression b because of the forward movement of the web. The actual depression is also dependent on a material-dependent factor $\mu$ which depends on the respective product, the type of fibers used, on previous compaction, and the like. As a result of the oscillation of the nozzle beam according to the invention, the linear depressions that always tilt toward the right or left. This inclination must be such that the depressions touch one another at their outer edges or even overlap slightly. The frequency f of the oscillating movement is critical in this regard, as are its amplitude A and the speed V of the fleece.

The relationships of these parameters can also be expressed in a mathematical relationship. Advantageously it is as follows:

The optimum production rate V, in other words the forward movement of the textile web, depends on the following equation:

$$V \text{ less than or equal to } W\max \times b/l$$

With the maximum speed Wmax calculated from $$W\max = F \times A \times 2\pi$$

and

F=frequency of the reciprocating movement (1/s, Hz),

A=amplitude (m), b=stripe width on web of goods (m) and l=distance between stripes (m). In an even more exact calculation, in the equation for the speed to be calculated, V is less than or equal to Wmax×b/l, the value $b = d \times \mu$ and d=hole diameter in nozzle sheet (m) and $\mu$=material-dependent factor of the actual stripe formation.

It is only when these parameters are taken into account that a smooth fleece can be obtained on the impacted surface with the individual water streams, which in any event produce a linear depression in the fiber structure when they strike the goods.

The oscillating movements should therefore be approximately 0.32–30 mm or more in both directions and have a frequency of approximately 10–200 Hz, depending on the feed rate of the fiber web. It is important relative to the subject of the invention that certain operating parameters be maintained. On the one hand, a solidification must be produced at least on the surface, in other words a change in the surface should be achieved, for which reason the hole diameter and the water pressure are significant. On the other hand, mechanical conditions must be considered. The amplitude must not be too high because otherwise the acceleration forces become too high. It is also important to ensure that the frequency of the oscillating movements is higher than in the prior art in order to achieve the production rate required in practice.

It is readily understandable that as a result of this reciprocating movement of the nozzle streams, in addition to the tanglelacing of the fibers, the same occurs in the lengthwise and transverse directions as well. This type of surface change can be intended both for compaction of the fleece or only for smoothing the surface. Thus, a hydrodynamic solidification system can consist of a plurality of needling stations which are intended exclusively for intensive bilateral compaction of the fleece, while the last or two last station(s) are provided with oscillating nozzle beams in order to smooth a surface by themselves or in addition to the compacting action. The shifting beams can be directed toward a drum or against an endless belt or can be suspended or on rails.

BRIEF DESCRIPTION OF THE DRAWINGS

A device of the type according to the invention is shown as an example in the drawing.

FIG. 1 is a perspective top view of a fiber web extending lengthwise with a nozzle beam for hydrolooping compaction located above it.

FIG. 2 shows the nozzle beam according to FIG. 1 in cross section.

DETAILED DESCRIPTION OF THE PREFERRED EMBODIMENTS

Figure 3:
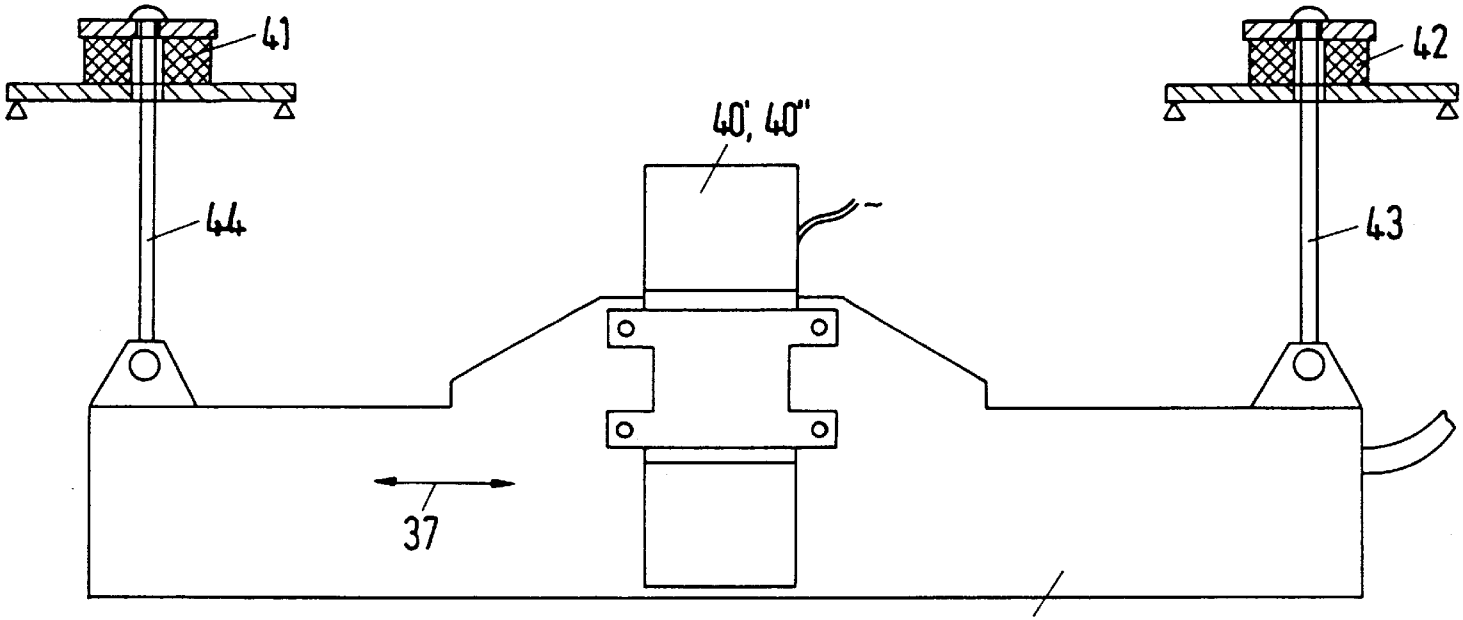
FIG. 3 shows the nozzle beam according to FIG. 1 with additional details in a side view.
Figure 4:
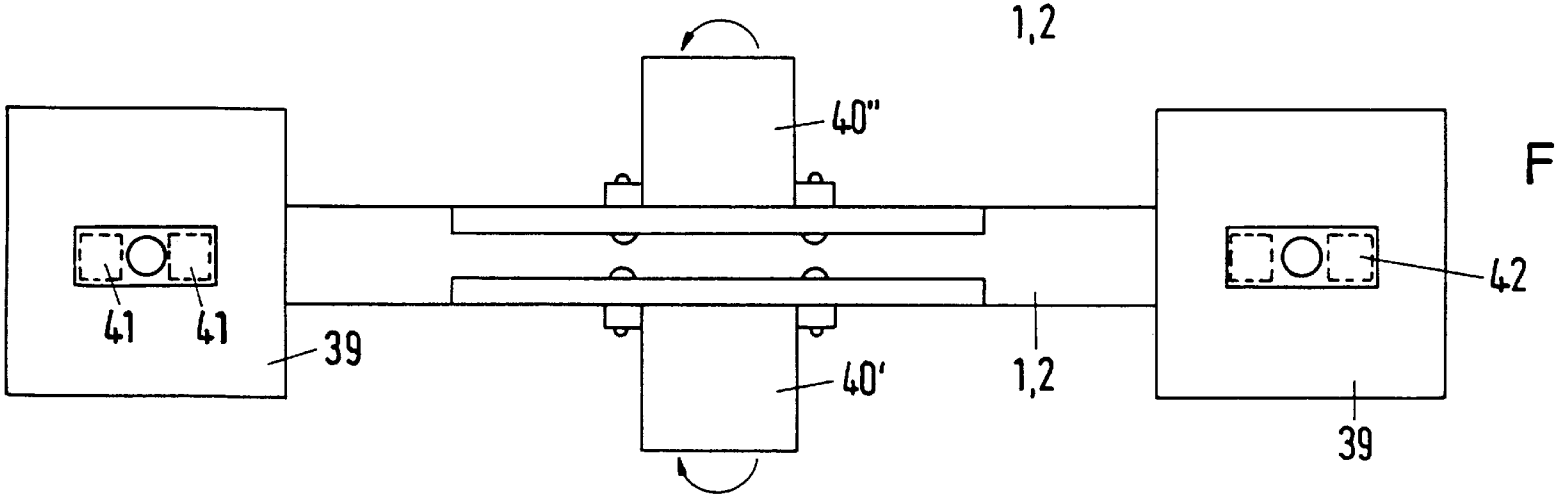
FIG. 4 is a top view of the nozzle beam in FIG. 3.

In FIG. 1, an endless belt 30 is shown schematically, said belt running together with the fiber web 31 to be compacted in the direction of arrow 32. A nozzle beam with upper part 1 is located transversely thereto, at a distance above the fiber web 31, with the structure of the beam being shown for example in FIG. 2 and described below. The nozzle beam is movably suspended on a fixed wall of housing 39. Fastening to housing 39 can be by spring steel. Another example of suspension is shown in FIG. 3. Another example could be for example a nozzle beam mounted on rails, not shown. The water streams 33 emerging from the nozzle slot 13 of the nozzle beam are directed against fiber web 31 and sweep the width of fiber web 31. The necessary water 35 reaches one end of the nozzle beam through a flexible hose 34 and then enters the nozzle beam. In the middle of the nozzle beam, according to FIG. 3, an electrically powered vibrator 40', 40" is attached to the beam. By means of this 40', 40", without adversely affecting a supporting housing, the nozzle beam alone is to be moved in the direction of the double arrow 37 in short oscillations, by which the water streams 33 are shifted back and forth laterally by more than the value of their diameter. Together with the feed rate 32 of fiber web 31, by means of the reciprocating nozzle beam, a zigzag pattern is produced by the individual water streams on the fiber web 31 which is inclined so that the depressions forming as a result of the water streams at least contact one another in their marginal areas. This nozzle beam, shown here alone, can be supplemented by at least one additional fixed nozzle beam, not shown here.

As in the case of Patent Application DE-A-195 01 738 described in detail, the housing of the nozzle beam in this example consists of the upper part 1 that is bolted to the lower part 2 at a number of locations lengthwise by bolts 3 from below. Upper part 1 has two holes 4 and 5 lengthwise, of which the upper is the pressure chamber 4 and the lower is the pressure distribution chamber 5. Both chambers are open at one end and bolted shut in a fluid-tight manner by a lid, not shown. In the vicinity of the other end, pressure chamber 4 has an opening through which the liquid 35 under pressure enters through a flexible hose 34. Over the length of the nozzle beam, a large number of through flow bores 9 chambers in an intermediate wall connect the two so that the liquid flowing into pressure chamber 4 flows out uniformly distributed over the length into pressure distribution chamber 5. The fluid that enters through the through flow bores 9 into pressure distribution chamber 5 distributes itself uniformly in the latter over the length of the nozzle beam. This is accomplished by the volume of the pressure distribution chamber 5 and an impact body 20 that is mounted over the length of the pressure distribution chamber 5 precisely between holes 9 and slot 10. The impact body 20 is secured at a distance from the intermediate wall 8 and allows the liquid to flow around it on all sides. In order to make this possible, the impact body is mounted at a distance in the intermediate wall 8 at many points over the length of the nozzle beam by bolts 21. In this manner, the liquid coming from the through flow bores 9 initially strikes the impact body 20, distributes itself in distribution chamber 5, and then flows with the same pressure over the length of the beam through the fine holes in nozzle sheet 14. The pressure distribution chamber is open at the bottom, specifically by means of the narrow slot 10 that is narrow relative to the diameter of the bore of the pressure distribution chamber 5, said slot likewise extending over the length of the beam.

According to FIG. 2, the upper part 1 is bolted permanently and in a fluid-tight manner to the lower part 2. The tightness is produced by O-ring 11 which fits into an annular groove in upper part 1. In the middle, between O-ring 11, a spring projection 23 surrounds slot 10, said projection fitting a matching groove 24 of lower part 2. An annular groove is provided in the bottom of groove 24 of lower part 2, in which groove O-ring 12 rests to seal off nozzle sheet 14. Likewise, a slot 13 is provided in a line below the fluid through bores 9 and slot 10 in lower part 2, said slot 13 being only very narrow in its upper area and leaving open only slightly more than the width of the effective nozzle openings of the nozzle sheet 14.

It is important for constructing the device that the nozzle beams 1, 2 be mounted so that the reciprocating oscillations 37 and their exciting unit cannot transmit to the rest of the housing of the complete device. Therefore, the vibrator 40' and 40" is suspended only from the nozzle beam and not the housing. The vibrator 40', 40" is flanged and distributed on both sides of the nozzle beam in such fashion that the reciprocating force of the vibrator engages in the vicinity of the center of gravity of the nozzle beam. This minimizes all of the reaction forces of the movements on the entire housing.

All of the nozzle beams in accordance with FIGS. 1 to 4 can also be mounted in series, but their movements should be opposite one another. In this fashion, any inhomogeneities in the surface appearance of the fleece will be compensated.

Figure 5:
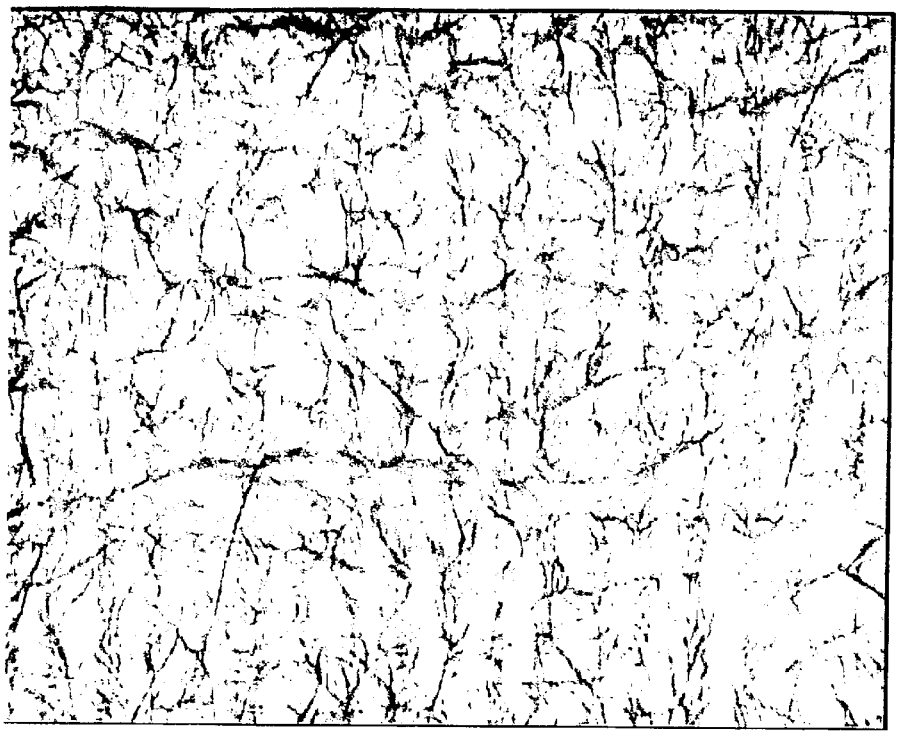
FIG. 5 is a photomicrograph with 16× enlargement of a fleece that has been subjected to a stationary nozzle beam.
Figure 6:
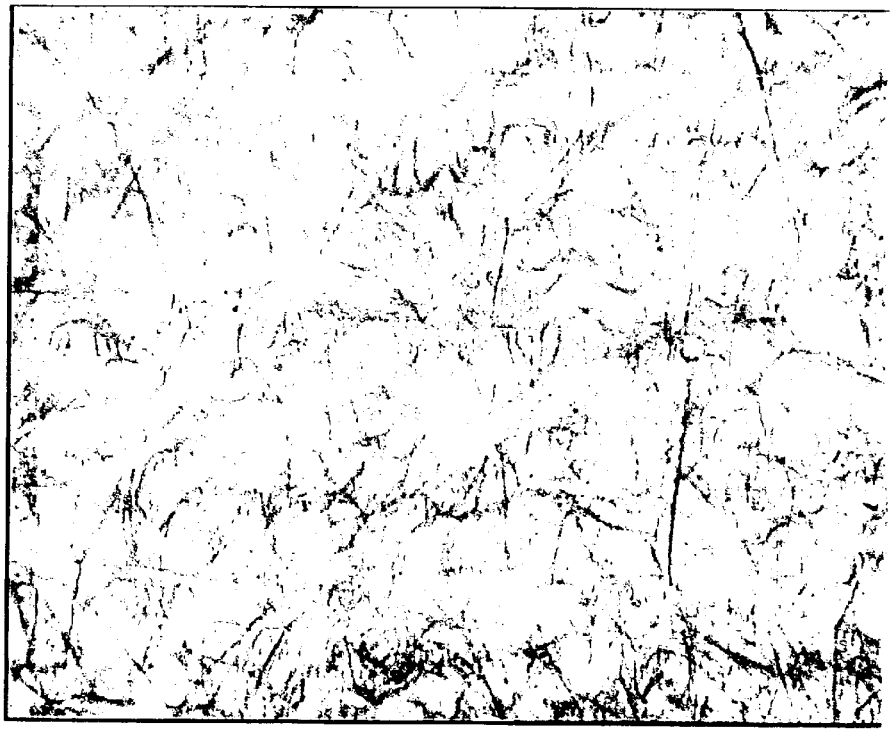
FIG. 6 is a photomicrograph likewise with 16× enlargement of the surface of the fleece with compaction being produced by a water beam shifting according to the invention.

FIGS. 5 and 6 show photomicrographs of the fleece. The fleece according to FIG. 5 is normally impacted by water streams, and therefore the nozzle beam has not moved. In incident light, the depressions b as well as the nozzle intervals l can be seen clearly. FIG. 6 by contrast shows a fleece that has been compacted by a nozzle beam oscillating according to the invention. Even under the microscope, no depressions or plastic surface changes can be seen.

What is claimed is:

1. Device with a nozzle beam for producing fluid streams for stream braiding of the fibers of textile web moving forward transversely to the nozzle beam by means of a liquid-permeable substrate, the nozzle beam comprising an upper part that extends over a working width of the fiber web and a lower part fastened to the upper part in a fluid-tight manner, with a pressure chamber being located in the upper part over a length of the upper part, said pressure chamber being supplied with liquid that is under pressure and a nozzle sheet is mounted on a bottom part with holes for nozzles in a fluid-tight manner, characterized in that the nozzle beam is movably mounted to shift back and forth lengthwise only in a direction perpendicular to the movement direction of the web;

the nozzle beam is connected perpendicularly to the movement direction of the web with a unit for rapid reciprocating movements, said unit subjecting only the nozzle beam to oscillating movements that change at short intervals the oscillating movements of the nozzle beam have a frequency of at least 10 Hz with a forward movement of the web of at least one meter per minute;

diameter of the nozzle holes is equal to or greater than 0.1 mm;

an amplitude of the oscillating movements is equal to or greater than half of the distance (1) between the holes in the nozzle sheet; and a fluid pressure of the fluid streams is a minimum of 30 bars.

2. Device according to claim 1, characterized in that the amplitude of the oscillating movements of the nozzle beam is between 0.32 and 30 mm.

3. Device according to claim 1 characterized in that the nozzle beam oscillates with a frequency between 10 and 200 Hz.

4. Device according to claim 1, characterized in that the unit for rapid reciprocating movements is at least one vibrator which engages in the vicinity of the center of gravity of the nozzle beam.

5. Device according to claim 4 characterized in that the vibrator is located independently of a housing supporting the nozzle beam.

6. Device according to claim 5 characterized in that the vibrator is suspended from the nozzle beam.

7. Device according to claim 1, characterized in that a plurality of nozzle beams are arranged one behind the other, with a changing fiber web contact with the respective liquid-permeable substrate, only the last or the next to last nozzle beam or nozzle beams are movably mounted and connected to the unit for rapid reciprocating movements.

8. Device according to claim 1, characterized in that two nozzle beams arranged one behind the other in a production direction are each connected to a unit for rapid reciprocating movements in opposite directions.

9. Device according to claim 1, characterized in that the amplitude of the oscillating movements of the nozzle beam is between 0.5 and 10 mm.

10. Device according to claim 1, characterized in that the nozzle beam oscillates with a frequency between 50 and 200 Hz.

11. Device as in claim 1, characterized in that a hole spacing in the nozzle sheet is 40 hpi.

12. A method for operating a nozzle beam for generating liquid streams for stream compaction of the fibers of a textile web, comprising moving the web forward transversely to the nozzle beam by means of a liquid-permeable substrate, the nozzle beam comprising an upper part that extends over a working width of the web and a lower part fastened to the upper part in a liquid-tight manner, with a pressure chamber being located in the upper part over a length of the upper part, said chamber being supplied with the liquid under pressure and with a nozzle sheet attached to the lower part with holes for nozzles mounted in a liquid-tight manner, and moving the nozzle beam with a reciprocating movement in a direction perpendicular to the forward movement direction of the web, characterized in that an optimum forward movement rate of the web depends on the following equation:

$$V \text{ less than or equal to } W\max \times b/l$$

with a maximum speed Wmax calculated from $$W\max = F \times A \times 2\pi,$$

where

F=frequency of the reciprocating movement (1/s, Hz),

A=amplitude (m), b=stripe width on web (m) and

1=distance between stripes (m).

13. Method according to claim 12 characterized in that $b=d\times\mu$ and d=hole diameter in nozzle sheet (m) and $\mu$=material-dependent factor of the actual stripe formation.

14. Method as in claim 12, characterized in that F is at least 10 Hz.

15. Method as in claim 12, characterized in that F is 10 to 200 Hz.

16. Method as in claim 12, characterized in that A is equal to or greater than half the distance 1 but less than 20 mm.

17. Method as in claim 12, characterized in that A is at least 0.32 mm.

18. Method as in claim 12, characterized in that A is 5 to 10 mm.

19. Method as in claim 12, characterized in that a fluid pressure of the liquid streams is at least 30 bars.

20. Method as in claim 13, characterized in that d is equal to or greater than 0.1 mm.

21. Method as in claim 12, characterized in that a hole spacing in the nozzle sheet is 40 hpi.

* * * * *